United States Patent [19]

Beekes

[11] 4,456,135

[45] Jun. 26, 1984

[54] HANDLE AND RESEAL FOR FLANGED BOTTLE

[76] Inventor: Huibertus A. Beekes, 433 Stagecoach Rd., Arroyo Grande, Calif. 93420

[21] Appl. No.: 332,941

[22] Filed: Dec. 21, 1981

[51] Int. Cl.[3] ..... B65D 23/12

[52] U.S. Cl. ..... 215/100 A; 220/94 R; 220/85 H; 294/27 R; 294/31 R

[58] Field of Search ..... 215/100 R, 100 A, 237, 215/239; 220/94, 85 H; 294/27.1, 31.1

[56] References Cited

U.S. PATENT DOCUMENTS 2,598,747 6/1952 Alex ..... 294/27.1

3,107,029 10/1963 Rylander ..... 220/85 H

*Primary Examiner*—George T. Hall

*Attorney, Agent, or Firm*—Daniel C. McKown

[57] ABSTRACT

An article which is a combined handle and reseal for use with a bottle of the type having a flange extending circumferentially around the neck of the bottle includes a body defining an aperture through which the portion of the neck of the bottle above the flange extends. The body includes a hook-like finger which hooks around the edge of the flange at a particular circumferential location, includes a seat for preventing the body from passing down the neck of the bottle beyond the flange, and includes a latch movably connected to the body for selectively removably securing the body to the flange of the bottle. A reseal is attached to the body for sealing and unsealing the bottle under control of the user. The article can be attached to the bottle and removed from it by the use of only one hand, and the same hand may also be used for sealing and unsealing the bottle.

26 Claims, 8 Drawing Figures

HANDLE AND RESEAL FOR FLANGED BOTTLE

BACKGROUND OF THE INVENTION

1. Field of the Invention

The present invention is in the field of containers and specifically relates to an article for handling and resealing a bottle of the type which typically is made of plastic and in which, typically, beverages are marketed.

2. The Prior Art

There appears to be a long-felt need for an article like the present invention. The marketing of soft beverages in 2-liter plastic bottles has increased greatly in the last decade, in spite of a number of disadvantages which such containers present for the consumer. Obviously, the 2-liter plastic bottles are rather heavy when full and hence are rather difficult to handle. The bottles are so large in diameter that women and children generally find it impossible to grasp the bottle at its waist. The difficulties are compounded by the fact that the walls of the bottle are somewhat flexible. If the bottle is opened and then grasped at its waist to be poured, the action of squeezing the bottle can cause some of the contents to overflow the bottle. Such bottles generally require the use of both hands for pouring.

Still other problems are encountered with the 2-liter plastic bottle when an attempt is made to reseal it. Unless great care is taken in the resealing operation, the bottom edge of the cap will start to seat on the seal-breaker portion of the thread at the top of the bottle before the top of the cap seats on the end of the bottle, with the result that such bottles frequently do not reseal well. A more satisfactory device for resealing is desirable.

The aforementioned difficulties have led to the development of the handle and reseal of the present invention.

SUMMARY OF THE INVENTION

The present invention is an article which includes several parts that are connected together to facilitate picking up, carrying, handling, pouring, and resealing of bottle of the type having a flange around its neck.

The article of the present invention can be affixed with one hand to a bottle. Likewise, the article of the present invention permits the bottle to be resealed using only one hand. The article of the present invention is reusable and can be removed from the bottle at will. The reseal portion of the present invention is connected to the remainder of the article, and this prevents the reseal from becoming separated from the handle portion of the article and becoming lost or misplaced. Finally, the article of the present invention is inexpensive to manufacture and could be used as a promotional item.

The structure of the article of the present invention is relatively simple in a preferred embodiment. In that embodiment, a body having an aperture is slipped over the neck of the bottle, about which it fits loosely. A finger which projects inwardly into the aperture at one side of the body is hooked beneath the flange of the bottle, and the body of the article is then pivoted until certain flanges on the walls of the aperture are seated on the upper surface of the flange of the bottle. Next, the user slides a latch which extends beneath the flange adjacent its lower surface to secure the body to the flange. The reseal is hinged to the body of the article and can be brought down over the open mouth of the bottle to seal it, and is normally latched in this position by the user. The entire operation of affixing the article to the flange and of resealing the bottle can be carried out using only one hand. In alternative embodiments, the latch which secures the article to the flange is rotatable rather than slidable, and in yet another alternative embodiment, the finger and seating flanges of the body are replaced by a clip which engages the flange of the bottle.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 4:
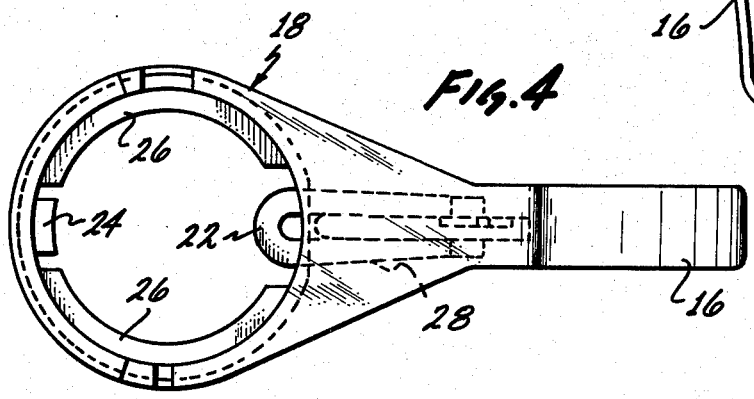
FIG. 4 is a top view of the handle of FIG. 3.
Figure 5:
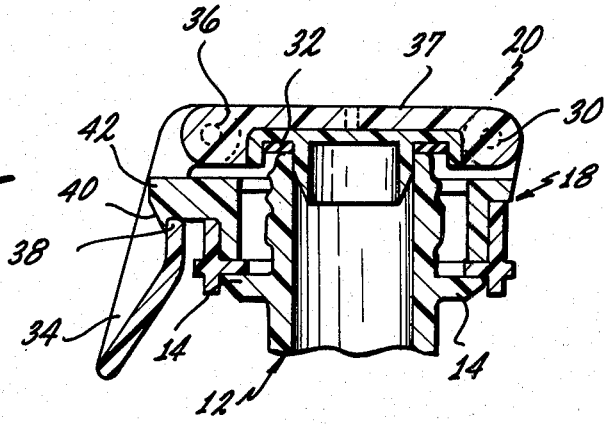
FIG. 5 is a side cross-sectional view showing the reseal in the preferred embodiment of the present invention.
Figure 6:
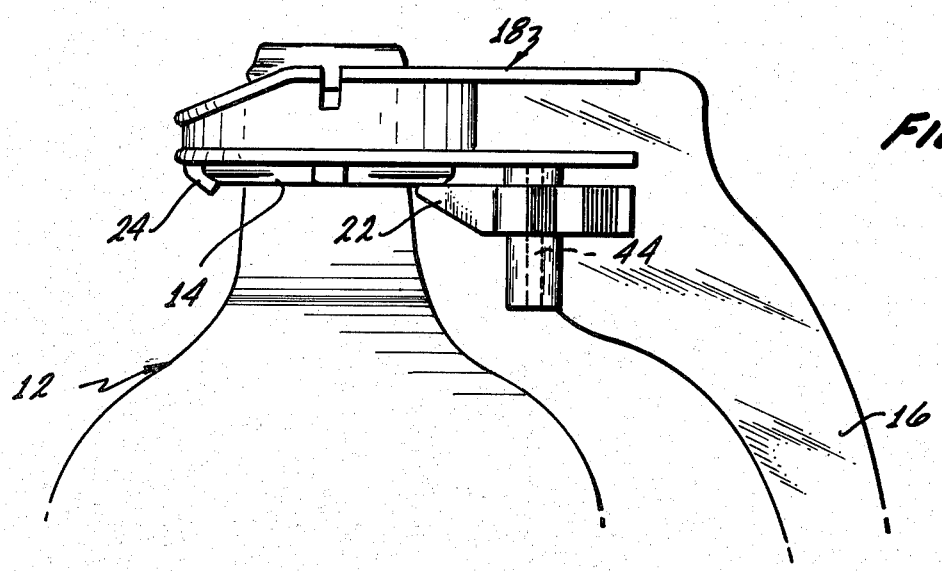
FIG. 6 is a side view of a handle in an alternative embodiment of the present invention.
Figure 7:
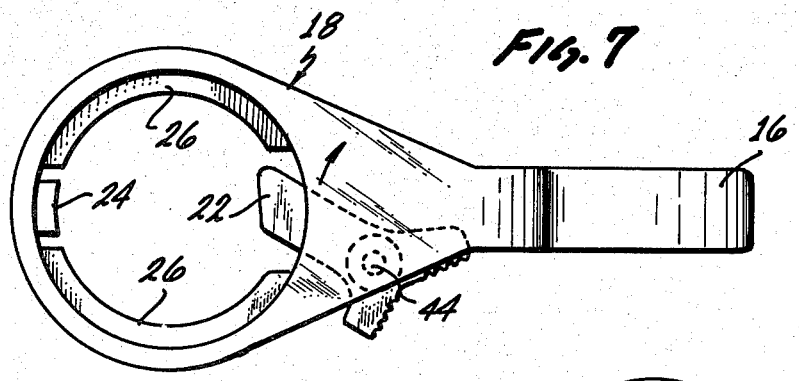
FIG. 7 is a top view of the handle of FIG. 6.
Figure 8:
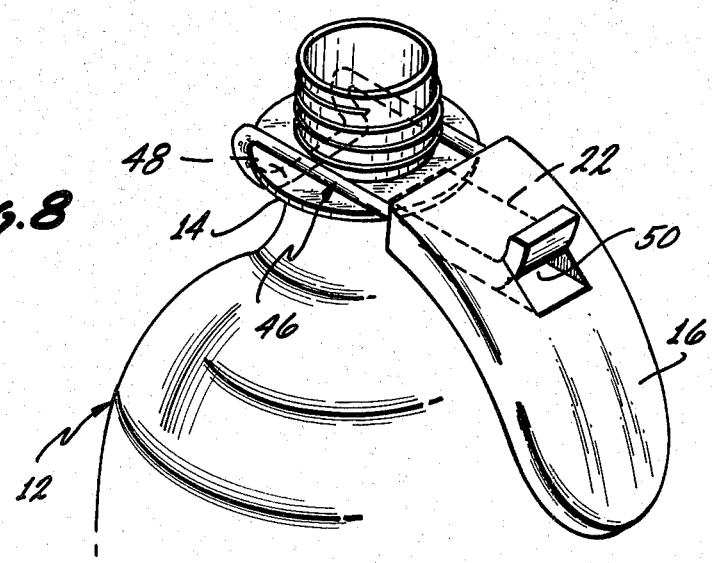
FIG. 8 is a perspective view of a second alternative embodiment of the handle of the present invention.

Turning now to the drawings, in which the same reference numeral will be used to denote similar parts, it will be noted that FIGS. 1–5 relate to a preferred embodiment of the invention, FIGS. 6 and 7 relate to a first alternative embodiment, and FIG. 8 relates to a second alternative embodiment.

Figure 1:
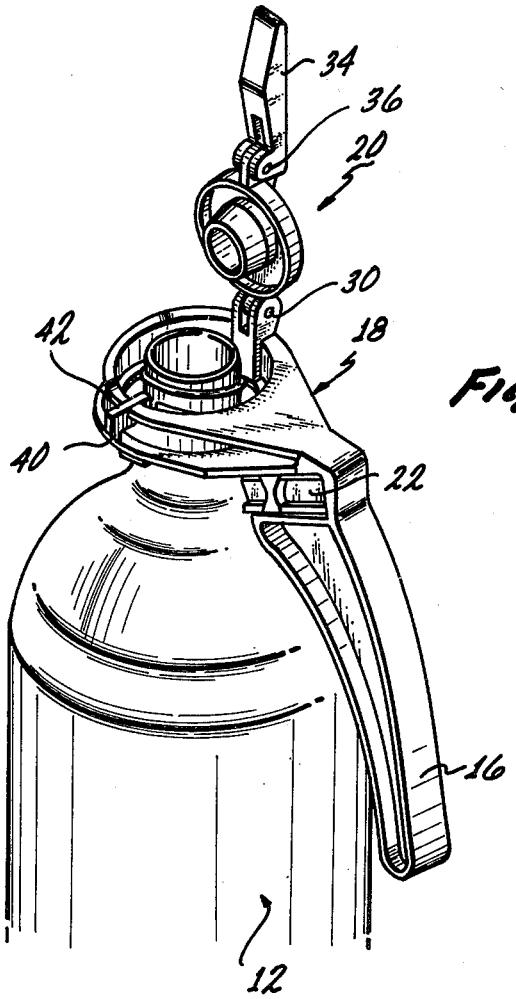
FIG. 1 is a perspective view showing the handle and reseal in accordance with a preferred embodiment of the present invention, with the reseal in an open position.
Figure 2:
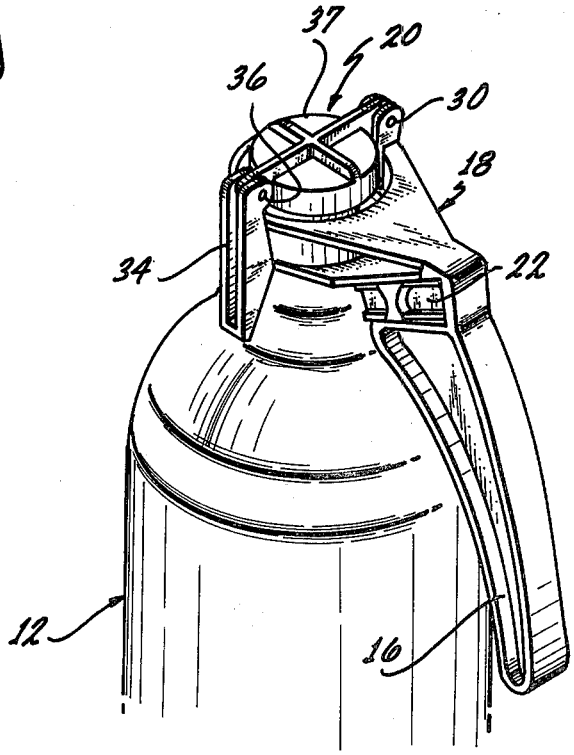
FIG. 2 is a perspective view showing a handle and reseal in accordance with the preferred embodiment of the present invention applied to a bottle and with the reseal in a closed position.

FIGS. 1 and 2 show the handle and reseal of the present invention affixed in place on a bottle 12. The bottle 12 includes a flange 14 around its neck, as best seen in FIGS. 3, 6 and 8.

The handle and reseal includes a grip 16 which the user can grasp to handle the bottle, a body 18, and a reseal 20. These parts are all connected so that there are no separate loose parts to the article. In the preferred embodiment, the body 18 includes a latch 22 which is slidably movable with respect to the body 18 for securing the handle and reseal to the flange 14 of the bottle. FIGS. 3–5 show various parts of the handle and reseal in greater detail.

Figure 3:
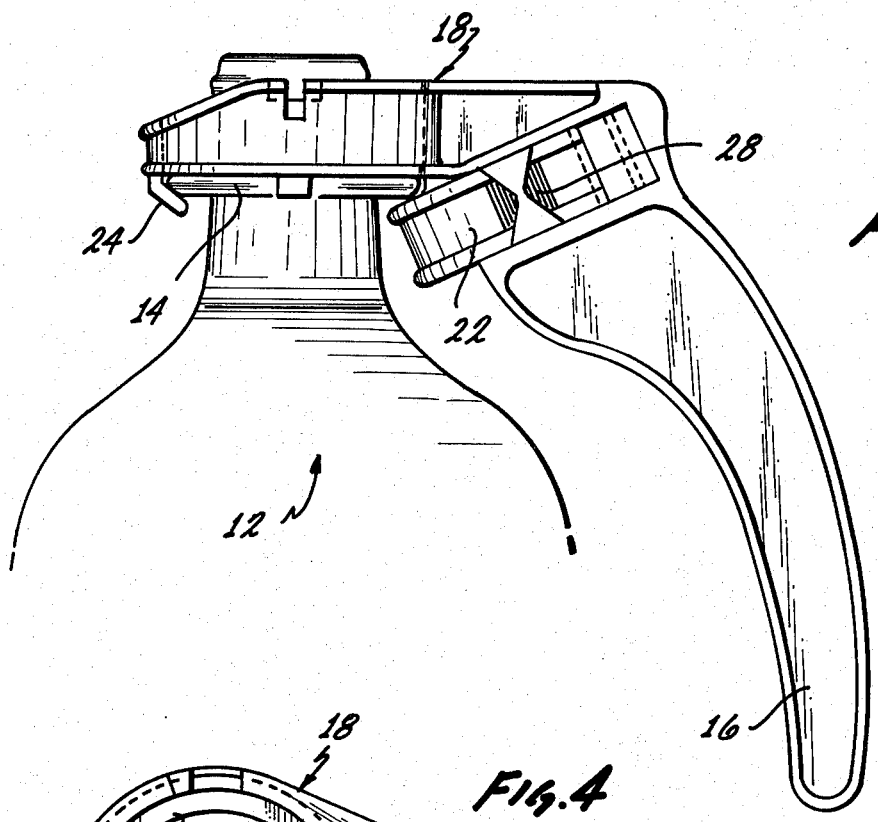
FIG. 3 is a side view of a handle in accordance with the preferred embodiment of the present invention.

FIGS. 3 and 4 show the body and grip of the handle, while FIG. 5 shows the reseal. The parts shown in FIGS. 3 and 4 could be used to provide a handle if that is all that were needed. As seen in FIGS. 3 and 4, the body 18 defines an aperture large enough to receive the portion of the neck of the bottle that lies above the flange 14. A finger 24 extends downwardly and inwardly from the body 18 into the aperture to hook under the flange 14 and to bear on the lower surface of the flange.

The body 18 also includes a seat 26 which extends into the aperture and which serves to prevent the body from sliding down the neck of the bottle beyond the flange 14. The seat 26 rests on the upper surface of the flange 14 when the handle has been affixed to the bottle.

In use, the user positions the body 18 above the top of the bottle, and lowers the body 18 tilting it slightly so as to hook the finger 24 under the flange 14, and then seating the seat 26 on the upper surface of the flange. Thereafter, the user slides the latch 22 in the direction indicated by the arrow in FIG. 3 to the position shown in FIG. 3, where it is seen that the latch 22 also bears against the lower surface of the flange 14, thereby securing the body 18 to the flange.

It is noteworthy that the latch 22 is located near the grip 16 so that the user can engage the body 18 to the flange 14 and secure it to the flange through the use of only one hand. The latch 22 is located adjacent the upper end of the grip 16 so that the latch 22 can be operated by the thumb of the user while the user grasps the grip 16 with his fingers. As seen in FIG. 4, the latch 22 has a U shape which permits thumb operation by both right-handed and left-handed users, since the latch 22 is accessible from both sides of the grip 16. In a preferred embodiment, the latch 22 includes serrations 28 to permit the thumb of the user to engage the latch 22 without slipping.

FIG. 5 shows the reseal in greater detail. It is seen that the reseal 20 is connected to the body 18 by the hinge 30. The reseal 20 includes a ring of a resilient facing 32 which sealingly engages the end of the bottle 12 when the reseal is closed. The reseal is closed by pivoting it from the open position shown in FIG. 1 to the closed position shown in FIGS. 2 and 5. The reseal 20 is located closely enough to the grip 16 that the reseal can be operated by the thumb of the user while the user grasps the grip 16 with his fingers.

It is normally desirable to secure the reseal 20 in the closed position of FIG. 5 through the use of the latch 34 which is hinged to the cap portion 37 by the hinge 36. The latch 34 includes an edge 38 which engages the edge 40 of the ear 42 to secure the reseal in the closed position.

FIGS. 6 and 7 show an alternative embodiment in which the handle is secured to the flange by a rotatable latch 22 instead of a slidable latch as was used in the embodiment of FIGS. 3 and 4. In the embodiments of FIGS. 6 and 7, the rotatable latch 22 is connected to the body of the handle by the hinge 44. In a further refinement of this embodiment, the hinge 44 can be replaced by a torsionally flexing member which keeps the latch 22 biased in the position shown in FIG. 7, so that the latch can be released only by a deliberate effort on the part of the user.

FIG. 8 illustrates yet another embodiment of the present invention in which the body 18 of the previous figures has been replaced by a clip 46. The clip 46 includes a portion 48 which is shaped to fit under the flange 14 in a manner similar to the finger 24 of FIGS. 3 and 6. The clip 46 is attached to a grip 16 which includes a channel 50 through which a slidable latch 22 can be shifted for securing the handle to the flange.

Thus, there has been described a handle and reseal for manipulating and resealing a widely used type of bottle. Several embodiments of the invention have been shown, and it is to be understood that additional embodiments thereof may be obvious to those skilled in the art. The embodiments described herein together with those additional embodiments are considered to be within the scope of the invention.

What is claimed is:

1. A handle which can be affixed to and removed from a bottle of the type having a flange extending circumferentially around the neck of the bottle, said flange having an upper surface and a lower surface, said handle comprising in combination:

attaching means for selectively removably attaching said handle to the flange under control of a user, said attaching means including finger means for engaging the flange, said finger means positioned to extend under the flange adjacent the lower surface of the flange when said handle has been affixed to the bottle; and, grip means connected to said attaching means and having an elongated shape conducive to being grasped by the user for manipulating the bottle.

2. The handle of claim 1 wherein said attaching means further comprise latch means movable by the user for securing said attaching means to the flange, said latch means located to selectively extend under the flange adjacent the lower surface of the flange on the opposite side of the flange from said finger means to secure said attaching means to the flange.

3. An article which is a combined handle and reseal for use with a bottle of the type having a flange extending circumferentially around the neck of the bottle and spaced above the shoulder of the bottle, the article comprising in combination:

attaching means for selectively removably attaching said article to the flange under control of a user;

grip means connected to said attaching means and having an elongated shape conducive to being grasped by the user for manipulating the bottle; and reseal means movably connected to said attaching means for selectively sealing and unsealing the bottle under control of the user.

4. The article of claim 3 wherein said reseal means is located sufficiently near said grip means that the user can seal and unseal the bottle with the same hand by which the user grasps said grip means.

5. The article of claim 3 wherein said reseal means is located sufficiently near said grip means that the user can operate said reseal means with the thumb of one hand while grasping said grip means with the fingers of the same hand.

6. The article of claim 3 wherein said reseal means further include a latch.

7. The article of claim 3 wherein said reseal means are hinged to said attaching means.

8. The article of claim 3 wherein said attaching means further comprise latch means movable by the user for selectively securing said attaching means to the flange and for selectively releasing said attaching means for engagement with the flange.

9. The article of claim 8 wherein said latch means further comprise a slidable portion of said attaching means.

10. The article of claim 8 wherein said latch means are located sufficiently near said grip means that the user can secure said article to the flange and release said article from engagement to the flange with the same hand by which the user grasps said grip means.

11. The article of claim 10 wherein said latch means are so located with respect to said grip means that the user can operate said latch means with the thumb of one hand while grasping said grip means with the fingers of the same hand.

12. The article of claim 3 wherein said attaching means further comprise finger means for engaging the flange, said finger means positioned to extend under the flange adjacent the lower surface of the flange when said article has been affixed to the bottle.

13. The article of claim 12 wherein said attaching means further comprise latch means movable by the user for securing said attaching means to the flange, said latch means located to selectively extend under the flange adjacent the lower surface of the flange on the opposite side of the flange from said finger means to secure said attaching means to the flange.

14. A handle which can be affixed to and removed from a bottle of the type having a flange extending circumferentially around the neck of the bottle, the flange having an upper surface and a lower surface, said handle comprising in combination:

a body defining an aperture large enough for the portion of the neck of the bottle above the flange to extend into and further including grip means;

seat means for preventing said body from passing down the neck of the bottle beyond the flange, projecting from said body inwardly into said aperture so as to rest on the upper surface of the flange after said handle has been affixed to the bottle;

finger means for removably engaging said body to the flange, positioned on said body at a first circumferential location about said aperture, projecting inwardly into said aperture, and positioned lower than said finger means so as to extend under the flange adjacent the lower surface of the flange after said handle has been affixed to the bottle; and, latch means for selectively removably securing said handle to the flange, movably connected to said body and movable by a user to a position in which said latch means extends at a second circumferential location under the flange adjacent the lower surface of the flange.

15. The handle of claim 14 wherein said latch means further comprise a slidable member.

16. The handle of claim 14 wherein said latch means are located sufficiently near said grip means that the user can secure said handle to the flange and release said handle from engagement to the flange with the same hand by which the user grasps said grip means.

17. The handle of claim 16 wherein said latch means are so located with respect to said grip means that the user can operate said latch means with the thumb of one hand while grasping said grip means with the fingers of the same hand.

18. An article which is a combined handle and reseal for use with a bottle of the type having a flange extending circumferentially around the neck of the bottle, the flange having an upper surface and a lower surface, said article comprising in combination:

a body defining an aperture large enough for the portion of the neck of the bottle above the flange to extend into and further including grip means;

seat means for preventing said body from passing down the neck of the bottle beyond the flange, projecting from said body inwardly into said aperture so as to rest on the upper surface of the flange after said article has been affixed to the bottle;

finger means for removably engaging said body to the flange, positioned on said body at a first circumferential location about said aperture, projecting inwardly into said aperture, and positioned lower than said finger means so as to extend under the flange adjacent the lower surface of the flange after said article has been affixed to the bottle;

latch means for selectively removably securing said body to the flange, movably connected to said body and movable by a user to a position in which said latch means extend at a second circumferential location under the flange adjacent the lower surface of the flange;

said body further including reseal means for selectively sealing and unsealing the bottle under control of the user.

19. The article of claim 18 wherein said latch means further comprise a slidable member.

20. The article of claim 18 wherein said latch means are located sufficiently near said grip means that the user can secure said article to the flange and release said article from engagement to the flange with the same hand by which the user grasps said grip means.

21. The article of claim 20 wherein said latch means are so located with respect to said grip means that the user can operate said latch means with the thumb of one hand while grasping said grip means with the fingers of the same hand.

22. The article of claim 18 wherein said reseal means is located sufficiently near said grip means that the user can seal and unseal the bottle with the same hand by which the user grasps said grip means.

23. The article of claim 18 wherein said reseal means is located sufficiently near said grip means that the user can operate said reseal means with thumb of one hand while grasping said grip means with the fingers of the same hand.

24. The article of claim 18 wherein said reseal means further include a latch.

25. The article of claim 18 wherein said reseal means are hinged to said body.

26. An article which is a combined handle and reseal for use with a bottle of the type having a flange extending circumferentially around the neck of the bottle and spaced above the shoulder of the bottle, the article comprising in combination:

attaching means for selectively removably attaching said article to the flange under control of a user;

grip means connected to said attaching means and having an elongated shape conducive to being grasped by the user for manipulating the bottle; and, reseal means movably connected to said attaching means for selectively sealing and unsealing the bottle under control of the user, said reseal means further including a latch.

* * * * *